US008159323B2

(12) United States Patent
Sugimura et al.

(10) Patent No.: US 8,159,323 B2
(45) Date of Patent: Apr. 17, 2012

(54) TRANSFORMER AND POWER SUPPLY APPARATUS USING THE SAME

(75) Inventors: Tomohiro Sugimura, Mie (JP); Toshifumi Toya, Mie (JP); Sadao Morimoto, Mie (JP)

(73) Assignee: Panasonic Corporation, Osaka (JP)

( * ) Notice: Subject to any disclaimer, the term of this patent is extended or adjusted under 35 U.S.C. 154(b) by 45 days.

(21) Appl. No.: 12/676,366

(22) PCT Filed: Sep. 16, 2008

(86) PCT No.: PCT/JP2008/002537

§ 371 (c)(1), (2), (4) Date: Mar. 4, 2010

(87) PCT Pub. No.: WO2009/037822

PCT Pub. Date: Mar. 26, 2009

(65) Prior Publication Data

US 2010/0194306 A1 Aug. 5, 2010

(30) Foreign Application Priority Data

Sep. 19, 2007 (JP) ..... 2007-241874

(51) Int. Cl.
*H01F 17/04* (2006.01)

(52) U.S. Cl. ..... 336/221

(58) Field of Classification Search ..... 336/65, 336/83, 170, 173, 180–184, 212, 220–223, 336/90

See application file for complete search history.

(56) References Cited

U.S. PATENT DOCUMENTS

| | | | | |
|---|---|---|---|---|
| 4,931,761 | A * | 6/1990 | Kijima | 336/160 |
| 5,440,225 | A | 8/1995 | Kojima | |
| 2006/0255900 | A1 | 11/2006 | Kohno | |
| 2009/0108979 | A1 * | 4/2009 | Kosugi et al. | 336/208 |

FOREIGN PATENT DOCUMENTS

| | | | |
|---|---|---|---|
| CN | 1921037 | A | 2/2007 |
| JP | 05-066934 | U | 9/1993 |
| JP | 09-293616 | A | 11/1997 |
| JP | 09-306754 | A | 11/1997 |
| JP | 2000-150255 | A | 5/2000 |
| JP | 2002-353038 | A | 12/2002 |
| JP | 2005-303103 | A | 10/2005 |
| JP | 2006080236 | A * | 3/2006 |
| JP | 3127552 | U | 11/2006 |
| JP | 2007-036191 | A | 2/2007 |
| JP | 2009-533039 | | 10/2011 |

OTHER PUBLICATIONS

Chinese Office Action for Application No. 200880107784.0, Aug. 2, 2011, Panasonic Corporation.

International Search Report for Application No. PCT/JP2008/002537, Oct. 14, 2008, Panasonic Corporation.

* cited by examiner

*Primary Examiner* — Tuyen Nguyen
(74) *Attorney, Agent, or Firm* — RatnerPrestia

(57) ABSTRACT

A transformer includes a first bobbin having a first primary winding and a first secondary winding wound therearound, having a first through hole; a second bobbin having a second primary winding and a second secondary winding wound therearound, having a second through hole; and two divided magnetic cores. A divided magnetic core is composed of center magnetic leg formed from a vertical wall and a side wall vertically linked to rear magnetic plate, with a T-shaped cross section; a first outer magnetic leg placed at one side separated by the vertical wall; and a second outer magnetic leg placed at the other side. The first and second outer magnetic legs are inserted from both sides of the first and second through hole.

8 Claims, 8 Drawing Sheets

TRANSFORMER AND POWER SUPPLY APPARATUS USING THE SAME

This Application is a U.S. National Phase Application of PCT International Application PCT/JP2008/002537.

TECHNICAL FIELD

The present invention relates to a transformer used for various types of electronic appliances.

BACKGROUND ART

Hereinafter, a description is made of a conventional transformer using the related drawings.

FIG. 11 is an exploded perspective view of a conventional transformer. In FIG. 11, bobbin 2 with primary winding 1 wound therearound has through hole 3; and bobbin 5 with secondary winding 4 wound therearound has through hole 6. Then, bobbin 2 has bobbins 5 arranged at both sides of bobbin 2.

Center leg 8 of E-shaped magnetic core 7 is inserted into through hole 3 of bobbin 2; outer leg 9 is inserted into through hole 6 of bobbin 5. After the front ends of center leg 8 and outer legs 9 are inserted into through holes 3, 6, center leg 8 and outer legs 9 are butt-joined to rod-shaped magnetic core 10 positioned facing E-shaped magnetic core 7 to form a transformer including a closed magnetic circuit. For instance, patent literature 1 is known as information on prior art documents related to this conventional transformer.

FIG. 12 is a first sectional view of a conventional transformer. In FIG. 12, magnetic flux $\phi 1$ generated at center leg 8 by primary winding 1 passes through closed magnetic circuit 11 composed of E-shaped magnetic core 7 and rod-shaped magnetic core 10. Then, magnetic flux $\phi 1$ is typically split into magnetic flux $\phi 2$ and $\phi 3$, exciting an equivalent voltage at secondary winding 4.

However, magnetic flux $\phi 2$ and $\phi 3$ is not evenly diverted when each impedance of loads (not shown) connected to secondary windings 4 fluctuates even if secondary windings 4 have the same winding specifications. That is to say, load fluctuation at one secondary winding 4 influences the other second secondary winding 4. This results in fluctuation of loads (not shown) at secondary windings 4 and fluctuation of magnetic flux $\phi 2$, $\phi 3$ interlinked at secondary windings 4 producing synergetic adverse affect. Consequently, with the loads (not shown) being discharge lamps, for instance, variation occurs in each brightness of the discharge lamps connected to one secondary winding 4 and the other.

FIG. 13 is a first sectional view of a conventional transformer. In FIG. 13, in a form of a transformer in which windings are arranged at both outer legs 9, center leg 8 is a common magnetic path between magnetic flux $\phi 3$ passing through one primary winding 1 and one secondary winding 4; and magnetic flux $\phi 4$ passing through the other primary winding 1 and the other secondary winding 4. In this case, when equal loads are connected to one secondary winding 4 and the other, magnetic flux $\phi 3$ and $\phi 4$ is equivalent and stabilized.

However, if the loads are not kept in equilibrium, magnetic flux $\phi 3$, $\phi 4$ cannot be maintained in balance, causing one secondary winding 4 to be subject to interference from the other magnetic flux $\phi 4$, and the other secondary winding 4 to be subject to interference from one magnetic flux $\phi 3$. Consequently, with the loads (not shown) being discharge lamps, for instance, variation occurs in each brightness of the discharge lamps connected to one secondary winding 4 and the other.

[Patent literature 1] Japanese Patent Unexamined Publication No. 2005-303103

SUMMARY OF THE INVENTION

The present invention provides a transformer less subject to interference between secondary windings due to load fluctuation at secondary windings.

A transformer according to this application includes a first bobbin having a first primary winding and a first secondary winding wound therearound and having a first through hole; a second bobbin having a second primary winding and a second secondary winding wound therearound and having a second through hole; and two divided magnetic cores. Each divided magnetic core is composed of a center magnetic leg formed from a vertical wall and a side wall vertically linked to a rear magnetic plate, with a T-shaped cross section; and a first outer magnetic leg placed at one side separated by the vertical wall and a second outer magnetic leg placed at the other side. The transformer is characterized in that the first outer magnetic legs are inserted from both sides of the first through hole and butt-joined together; the second outer magnetic legs are inserted from both sides of the second through hole and butt-joined together; and then the center magnetic legs are butt-joined together.

According to the present invention, as a result that the number of magnetic paths through which magnetic flux passing through each secondary winding commonly travels is reduced; and that magnetic paths through which magnetic flux heading to each secondary winding travels are separated on the magnetic circuit, interference can be made hard to occur due to load fluctuation between secondary windings. In other words, the present invention offers a transformer that provides stable output less subject to interference between secondary windings due to load fluctuation at the secondary windings.

REFERENCE MARKS IN THE DRAWINGS

Figure 1:
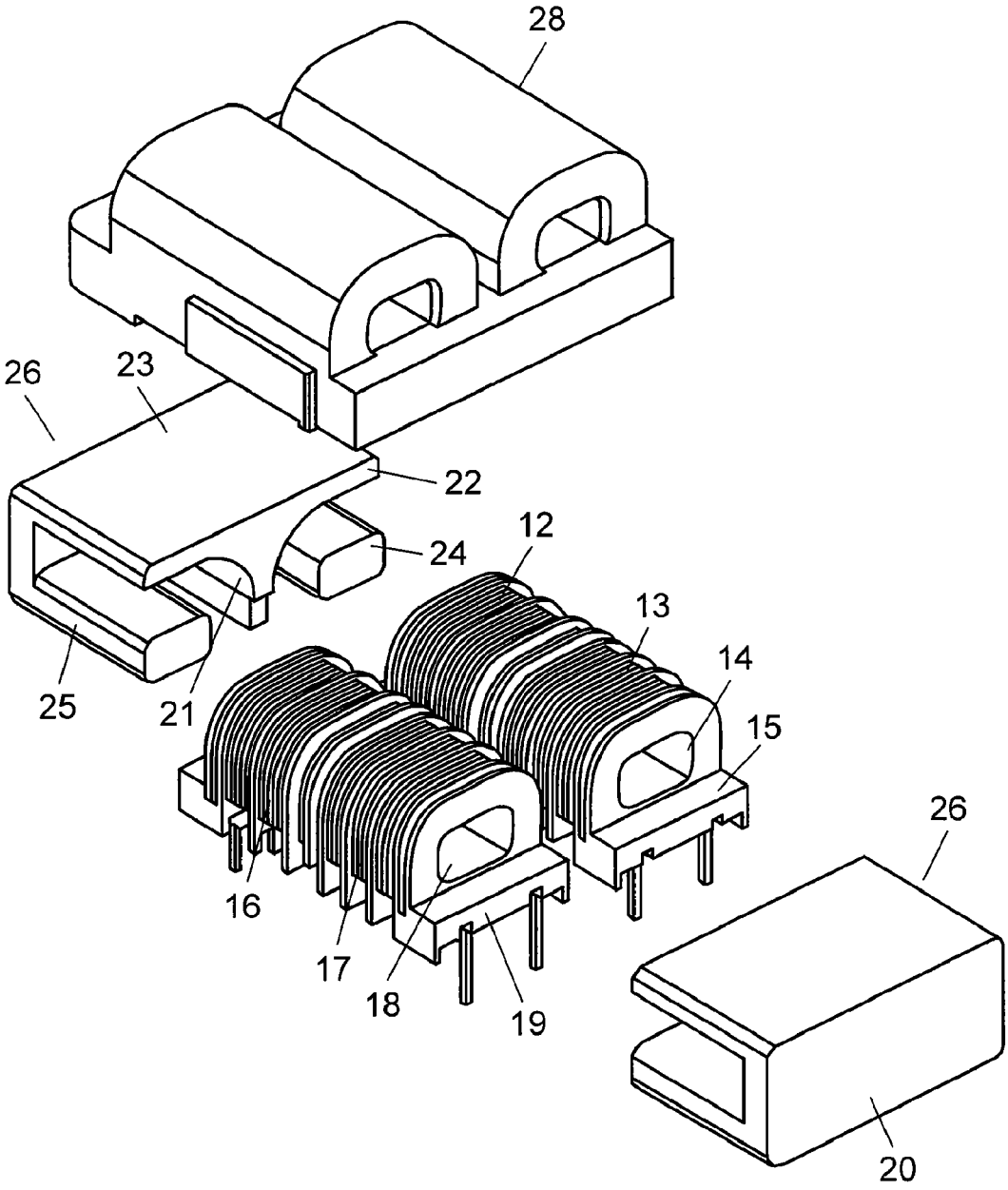
FIG. 1 is an exploded perspective view of a transformer according to the first exemplary embodiment of the present invention.

12, 37 First primary winding
13, 38 First secondary winding
14, 39 First through hole
15, 40 First bobbin
16, 41 Second primary winding
17, 42 Second secondary winding
18, 43 Second through hole
19, 44 Second bobbin
20, 45 Rear magnetic plate
21 Vertical wall
22 Side wall
23 Center magnetic leg
24, 47 First outer magnetic leg
25, 48 Second outer magnetic leg
26, 49 Divided magnetic core

DETAILED DESCRIPTION OF PREFERRED EMBODIMENTS

First Exemplary Embodiment

FIG. 1 is an exploded perspective view of a transformer according to the first exemplary embodiment of the present invention. In FIG. 1, the transformer of the first embodiment includes first bobbin 15 and second bobbin 19, which are arranged in parallel with each other.

First bobbin 15 is formed from first primary winding 12 and first secondary winding 13 wound around first through hole 14. Second bobbin 19 is formed from second primary winding 16 and second secondary winding 17 wound around second through hole 18.

Here, first primary winding 12 and second primary winding 16 have the same winding number. First secondary winding 13 and second secondary winding 17 as well have the same winding number.

Further, the transformer of the first embodiment has divided magnetic core 26. Divided magnetic core 26 is composed of rear magnetic plate 20, center magnetic leg 23, first outer magnetic leg 24, and second outer magnetic leg 25. Center magnetic leg 23, with a T-shaped cross section, is composed of vertical wall 21 and side wall 22. Vertical wall 21 extends downward from side wall 22. Vertical wall 21 and side wall 22 are vertically linked to rear magnetic plate 20. First outer magnetic leg 24 and second outer magnetic leg 25 are vertically linked to rear magnetic plate 20. These legs are separated from each other by vertical wall 21.

Then, first outer magnetic legs 24 are inserted from both sides of first through hole 14, and their front ends are butt-joined together in first through hole 14. Similarly, second outer magnetic legs 25 are inserted from both sides of second through hole 18, and their front ends are butt-joined together in second through hole 18. Further, center magnetic legs 23 are butt-joined together. Center magnetic leg 23 encompasses halfway around first bobbin 15 and second bobbin 19 in the direction with first through hole 14 and second through hole 18 being as axes.

Figure 2:
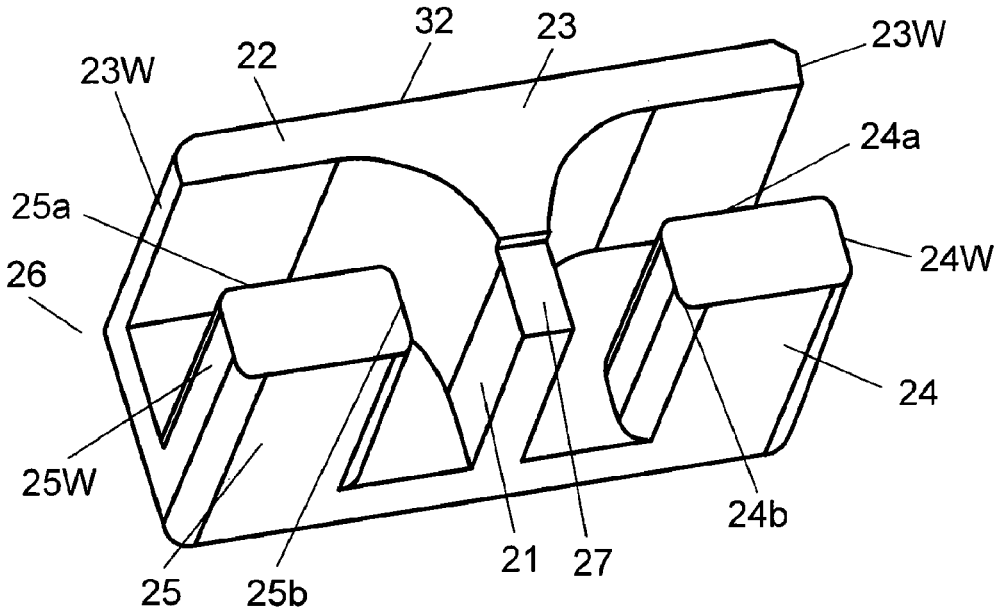
FIG. 2 is a perspective view of a divided magnetic core included in the transformer according to the first embodiment of the present invention.

FIG. 2 is a perspective view of the divided magnetic core included in the transformer according to the first embodiment of the present invention. In FIG. 2, stepped part 27 provided at the front end of vertical wall 21 of center magnetic leg 23 forms a void when center magnetic legs 23 are butt-joined together, thus forming a magnetic gap. Stepped part 27 provided at least at one divided magnetic core 26 forms a magnetic gap. Here, center magnetic legs 23 are butt-joined together desirably with a magnetic gap formed, although it may be butt-joined together without a magnetic gap formed.

Figure 3:
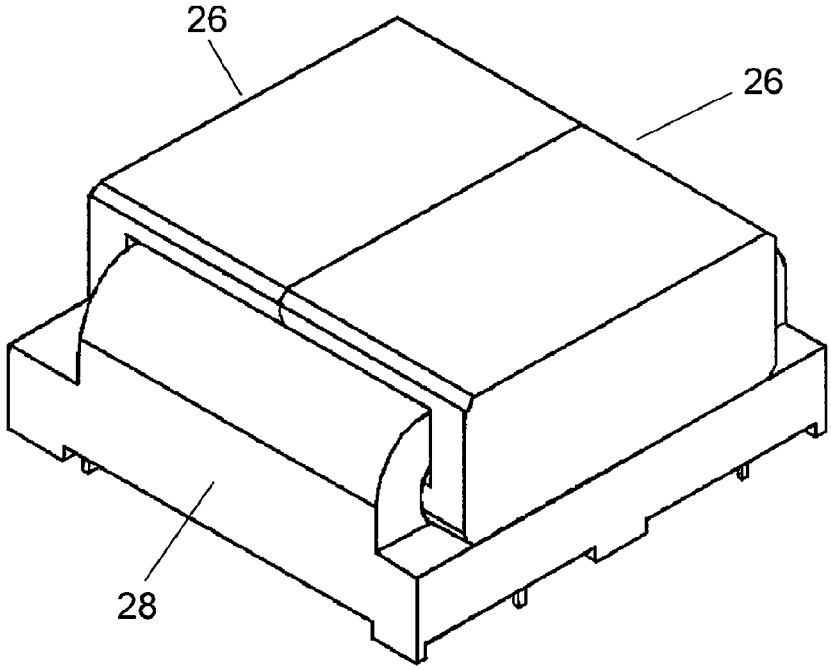
FIG. 3 is a perspective view of the transformer according to the first embodiment of the present invention.

FIG. 3 is a perspective view of the transformer according to the first embodiment of the present invention. In FIG. 3, the transformer of the first embodiment has case 28 in addition to first bobbin 15, second bobbin 19, and divided magnetic core 26. Case 28 is provided to increase the insulation performance between first bobbin 15, second bobbin 19, and divided magnetic core 26.

For details, the primary winding (not shown) and secondary winding (not shown) are electrically insulated from the outside by case 28. Divided magnetic core 26 covers a half or more area of the top surface of the transformer of the first embodiment, thereby magnetically shielding the primary winding (not shown) and secondary winding (not shown) from the outside. To maintain such a shielded state, it is adequate if one of the following conditions are satisfied. Firstly, outer side surfaces 24W, 25W of first outer magnetic leg 24 and second outer magnetic leg 25 are coplanar with outer side surface 23W of center magnetic leg 23 as shown in FIG. 2. Secondly, outer side surface 23W of center magnetic leg 23 projects outward beyond outer side surfaces 24W, 25W like eaves.

Figure 4:
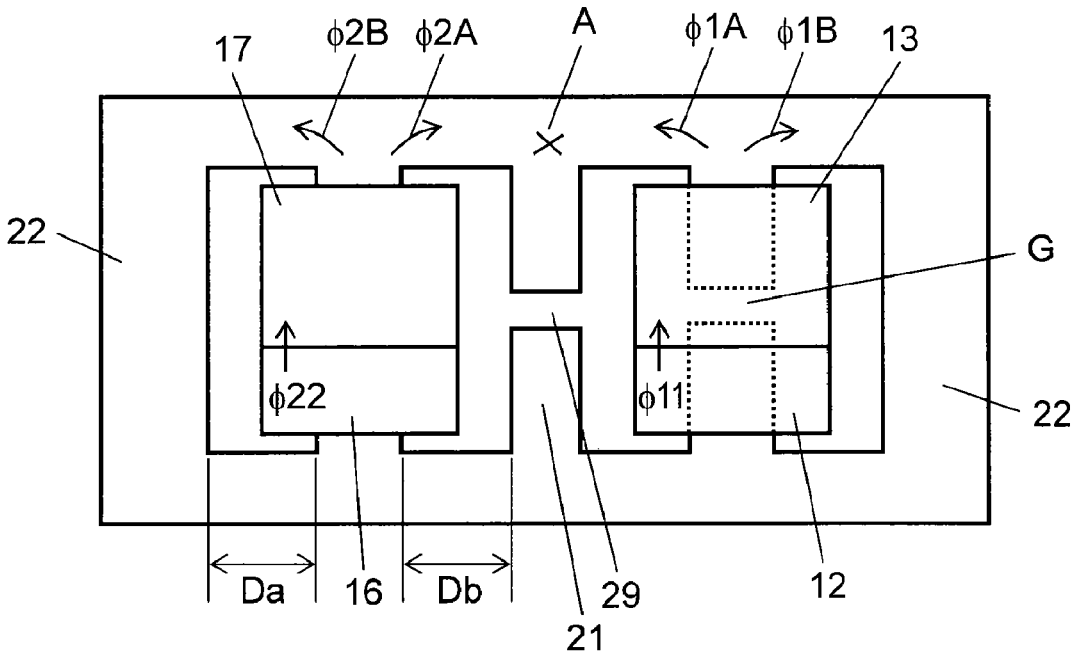
FIG. 4 is a first plan view of the transformer according to the first embodiment of the present invention.

FIG. 4 is a first plan view of the transformer according to the first embodiment of the present invention. In FIG. 4, point A is the center point of rear magnetic plate 20 forming divided magnetic core 26. Here, the assumption is made that magnetic flux $\phi$11 generated from first primary winding 12 and magnetic flux $\phi$22 generated from second primary winding 16 respectively become $\phi$1A and $\phi$2A heading to point A. Then, the magnetic flux, even if merging at point A, does not pass through vertical wall 21 due to extremely high reluctance caused by the presence of magnetic gap 29 at the front end of vertical wall 21. Consequently, magnetic flux $\phi$11 generated from first primary winding 12 and magnetic flux $\phi$22 generated from second primary winding 16 do not head to $\phi$1A and $\phi$2A, respectively. Here, the reluctance is increased by providing magnetic gap 29. Instead, the reluctance may be increased by reducing the cross-sectional area of vertical wall 21.

On the other hand, the assumption is made that magnetic flux $\phi$11 generated from first primary winding 12 and magnetic flux $\phi$22 generated from second primary winding 16 respectively become $\phi$1B and $\phi$2B heading opposite to point A. Then, the absence of a magnetic gap and extremely low reluctance at side wall 22 cause no conflict between the directions of magnetic flux $\phi$1B and $\phi$2B.

Figure 5:
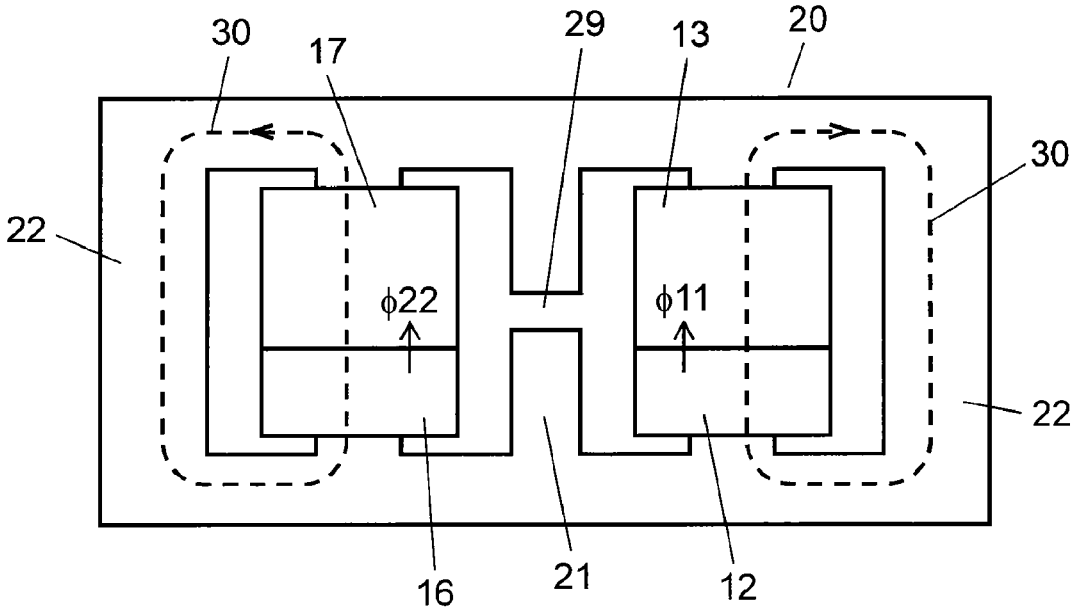
FIG. 5 is a second plan view of the transformer according to the first embodiment of the present invention.

FIG. 5 is a second plan view of the transformer according to the first embodiment of the present invention. In FIG. 5, magnetic flux $\phi$11 generated from first primary winding 12 and magnetic flux $\phi$22 generated from second primary winding 16 respectively pass through the loops shown by broken-line arrows 30 corresponding to a part with the lowest reluctance.

Magnetic flux $\phi$11 generated from first primary winding 12 does not travel through a magnetic path same as that of magnetic flux $\phi$22 generated from second primary winding 16. Accordingly, even if a load (not shown) connected to first secondary winding 13 is not in equilibrium with a load (not shown) connected to second secondary winding 17, fluctuation of magnetic flux due to load fluctuation at one side unlikely influences magnetic flux at the other side. In other words, in spite of the magnetic core being integrally formed from vertical wall 21 and side wall 22, each magnetic path is provided with different reluctances, which allows discriminating between a magnetic path easy to pass magnetic flux and the other. Consequently, stable output is available less subject to interference due to load fluctuation at first secondary winding 13 and second secondary winding 17. Divided magnetic core 26 is in a mechanically integral state; magnetically, however, first primary winding 12 and first secondary winding 13 can be separated from second primary winding 16 and second secondary winding 17.

First primary winding 12 and first secondary winding 13 are arranged coaxially. Similarly, second primary winding 16 and second secondary winding 17 are arranged coaxially. Accordingly, magnetic flux ϕ11 and ϕ22 generated at first primary winding 12 and second primary winding 16 are accurately interlinked respectively at first secondary winding 13 and second secondary winding 17, making the energy conversion efficiency favorable. Further, providing a gap between first primary winding 12 and first secondary winding 13, for instance, allows retaining a certain level of coupling with a creeping distance maintained.

Vertical wall 21 magnetically shields magnetic flux leakage discharged from first primary winding 12 and first secondary winding 13; and second primary winding 16 and second secondary winding 17 from each other. Side wall 22, with extremely low reluctance, suppresses flux leaking from the transformer to the outside of the transformer. Here, magnetic flux leakage can be suppressed not only in the direction where side wall 22 is present but also at its side where side wall 22 is not present.

Here, arrangement is made so that magnetic flux ϕ11 generated from first primary winding 12 and magnetic flux ϕ22 generated from second primary winding 16 both head to one rear magnetic plate 20, or in the direction opposite to one rear magnetic plate 20. Further, extending stepped part 27 shown in FIG. 2 to a part contacting side wall 22 at the entire butt-joined side of vertical wall 21 enlarges magnetic gap 29 shown in FIG. 4.

Figure 6:
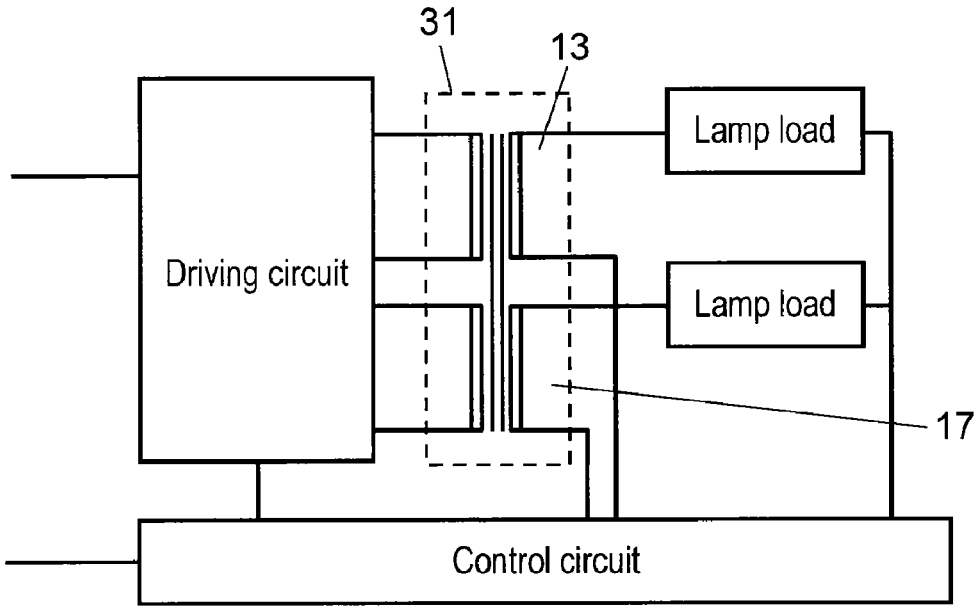
FIG. 6 is a connection circuit diagram of the transformer according to the first embodiment of the present invention.

FIG. 6 is a connection circuit diagram of the transformer according to the first exemplary embodiment of the present invention. In FIG. 6, transformer 31 of the first embodiment is one component. First secondary winding 13 is magnetically separated from second secondary winding 17 inside transformer 31.

Figure 7A:
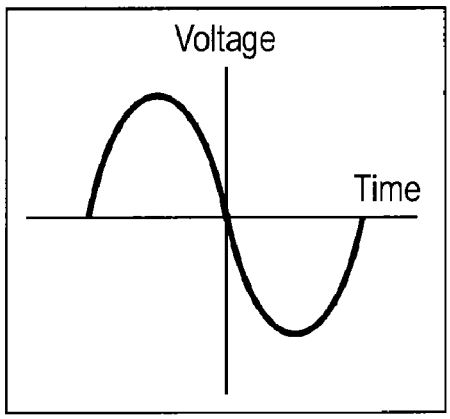
FIG. 7A is a waveform chart of a voltage output from the first secondary winding of the transformer according to the first embodiment of the present invention.
Figure 7B:
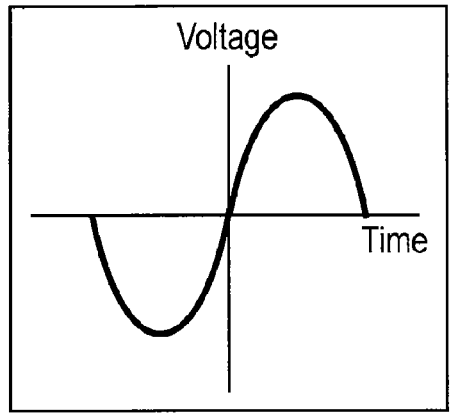
FIG. 7B is a waveform chart of a voltage output from the second secondary winding of the transformer according to the first embodiment of the present invention.

FIG. 7A is a waveform chart of a voltage output from the first secondary winding of the transformer according to the first embodiment of the present invention. FIG. 7B is a waveform chart of a voltage output from the second secondary winding of the transformer according to the first embodiment of the present invention. In FIGS. 7A, 7B, a large imbalance unlikely occurs in peak values of voltage output from first secondary winding 13 and second secondary winding 17.

Here, voltages output from first secondary winding 13 and second secondary winding 17 are in opposite phase. This is because of the following reason. With discharge lamps used for loads, electric fields and the like discharged from the discharge lamps cancel out one another due to the opposite-phase connection to reduce influence to the environment, where operation in the same phase does not pose any problems in operation as a transformer.

In the description of the structure and operation described above, the presence or absence of a magnetic gap is not mentioned regarding the butt-joined part (not shown) of first outer magnetic leg 24 and the butt-joined part (not shown) of second outer magnetic leg 25 shown in FIG. 1. However, magnetic gaps (not shown) may be provided at the butt-joined part of first outer magnetic legs 24 and that of second outer magnetic legs 25.

When providing magnetic gaps at the butt-joined part of first outer magnetic leg 24 and that of second outer magnetic leg 25, a part corresponding to a step height same as that of stepped part 27 is cut from the front ends of first outer magnetic leg 24 and second outer magnetic leg 25 when forming stepped part 27 as shown in FIG. 2. Herewith, the magnetic gaps provided at first outer magnetic leg 24 and second outer magnetic leg 25 can be made have nearly equivalent dimensions.

Even if magnetic gaps are formed at the three positions: first outer magnetic leg 24, second outer magnetic leg 25, and vertical wall 21, the dimensions of the magnetic gaps unlikely become unstable because a closed magnetic circuit is formed by butt-joining the unformed part of stepped part 27 of vertical wall 21 and side wall 22 together. Consequently, the stable butt-joined surfaces at the three positions allow omitting film insertion for stabilizing magnetic gaps.

Magnetic gaps formed at the front ends of first outer magnetic leg 24 and second outer magnetic leg 25 are positioned where they are contained by first primary winding 12 and first secondary winding 13, and second primary winding 16 and second secondary winding 17, like magnetic gap G shown in FIG. 4. Hence, much magnetic flux leakage unlikely occurs. Further, as shown in FIG. 1, side walls 22 of center magnetic legs 23 are butt-joined together without a magnetic gap, and thus magnetic flux leakage is shielded from the outside. Accordingly, the arrangement unlikely causes magnetic disadvantageous effect on other devices as well as suppressing loss of energy conversion due to magnetic flux leakage.

To better keep output voltage in equilibrium, first outer magnetic leg 24 and second outer magnetic leg 25, and side wall 22 are desirably positioned symmetrically with respect to vertical wall 21 as shown in FIG. 2. In other words, as shown in FIG. 1, with respect to vertical wall 21, first primary winding 12 and first secondary winding 13 are bilaterally symmetric with second primary winding 16 and second secondary winding 17. Herewith, the reluctance at the right and left magnetic circuits (first bobbin 15, second bobbin 19) can be made equal, thereby further suppressing interference caused by first secondary winding 13 and second secondary winding 17. With nearly identical specifications of first primary winding 12 and first secondary winding 13, and second primary winding 16 and second secondary winding 17, each voltage output from first secondary winding 13 and second secondary winding 17 can be kept equal.

Here, in the first embodiment, first outer magnetic leg 24 and second outer magnetic leg 25, and side wall 22 shown in FIG. 2 may be asymmetric with respect to vertical wall 21. In other words, vertical wall 21 may be arranged at a position deviating from the center between first outer magnetic leg 24 and second outer magnetic leg 25 to one side or the other. In this case, when one divided magnetic core 26 and other divided magnetic core 26 are butt-joined together, they have nearly identical dimensions, except that each vertical wall 21 are at deviating positions. Both side walls 22 are in a butt-joined state straightly facing each other with nearly exact matching. Vertical walls 21, being deviating, do not face each other completely straightly, but are in a butt-joined state deviating vertically to the direction in which vertical wall 21 extends.

Here, with the deviating degree of vertical walls 21 less than half the thickness of vertical wall 21 from the center of divided magnetic core 26, both vertical walls 21 are always partially in a butt-joined state. Herewith, side wall 22 and the above-described partially butt-joined part form butt-joined planes at three positions in total. Accordingly, one divided magnetic core 26 and the other can be kept in a stable positional relationship.

The cross-sectional area of a magnetic path passing through side wall 22 does not vary with a deviation of vertical wall 21. However, the cross-sectional area of a magnetic path passing through vertical wall 21 results in a significant decrease due to a deviation of the vertical wall. Herewith, as shown in FIG. 4, the reluctance of a path through which magnetic flux related to interference due to ϕ1A and ϕ2A further increases. Consequently, magnetic flux related to interference due to ϕ1A and ϕ2A further decreases, thereby suppressing interference due to ϕ1A and ϕ2A.

At this moment, vertical wall 21 shown in FIG. 1 is not positioned at the center of divided magnetic core 26. Hence, the winding numbers of first primary winding 12 and first secondary winding 13, and second primary winding 16 and second secondary winding 17 are changed to balance the voltages output from first secondary winding 13 and second secondary winding 17. In other words, asymmetric winding specifications corresponding to the asymmetric shape of the magnetic core maintains the output voltage characteristics in a symmetric state.

Although both divided magnetic core 26 have different shapes, those with an identical shape may be butt-joined basically. In other words, as a result that vertical walls 21 with an identical shape and vertical walls 21 deviating with the same degree are butt-joined together, butt-joining is made in a form deviating vertically to the direction in which vertical wall 21 extends. Accordingly, cost related to molding a divided magnetic core does not rise. Stepped part 27 shown in FIG. 2 for forming a magnetic gap can be provided either at both divided magnetic cores 26 or at one divided magnetic core 26.

Further, to suppress mutual interference between first secondary winding 13 and second secondary winding 17, the distance from first outer magnetic leg 24 and second outer magnetic leg 25 to side wall 22 is desirably shorter than the distance from first outer magnetic leg 24 and second outer magnetic leg 25 to vertical wall 21.

In FIG. 4, the distance from top surface 24*a* of first outer magnetic leg 24 and top surface 25*a* of second outer magnetic leg 25 to side wall 22 is assumed to be Da. The distance from side 24*b* of first outer magnetic leg 24 and side 25*b* of second outer magnetic leg 25 to vertical wall 21 is assumed to be Db. Here, Da and Db desirably satisfy Da<Db. Then, the reluctance of magnetic flux loop 30 shown in FIG. 5 can be made lower than that at magnetic gap 29. Meanwhile, magnetic paths are separated more clearly, thereby suppressing mutual interference between first secondary winding 13 and second secondary winding 17. Further, side wall 22 makes it harder for magnetic flux leaking from first primary winding 12, second primary winding 16, first secondary winding 13, and second secondary winding 17 to be discharged outside the product.

To make the reluctance of magnetic flux loop 30 lower than that at magnetic gap 29, the cross-sectional area of side wall 22 shown in FIG. 1 is desirably twice or more of the cross-sectional area of vertical wall 21. In other words, this is a state in which the cross-sectional area of a part of side wall 22 facing first primary winding 12 and first secondary winding 13 is larger than the cross-sectional area of vertical wall 21. This is also a state in which the cross-sectional area of a part of side wall 22 facing second primary winding 16 and second secondary winding 17 is larger than the cross-sectional area of vertical wall 21. That is to say, this is a state in which half the entire cross-sectional area of side wall 22 is larger than the cross-sectional area of vertical wall 21. Herewith, the reluctance of magnetic flux loop 30 shown in FIG. 5 can be made lower than the reluctance at magnetic gap 29, even if magnetic gap 29 is not present. Accordingly, magnetic paths are separated more clearly, thereby suppressing mutual interference due to first secondary winding 13 and second secondary winding 17.

Further, a description is made of the cross-sectional area of rear magnetic plate 20 shown in FIG. 1. The cross-sectional area of parts of rear magnetic plate 20 positioned between vertical wall 21 and first outer magnetic leg 24, and between vertical wall 21 and second outer magnetic leg 25 is made smaller than the cross-sectional area of parts of rear magnetic plate 20 positioned between side wall 22 and first outer magnetic leg 24, and between side wall 22 and second outer magnetic leg 25. Herewith, the reluctance of magnetic flux loop 30 shown in FIG. 5 can be made lower than the reluctance at magnetic gap 29, even if magnetic gap 29 is not present. Accordingly, magnetic paths are separated more clearly in the same way as in the above case, thereby suppressing mutual interference due to first secondary winding 13 and second secondary winding 17.

Second Exemplary Embodiment

Figure 8:
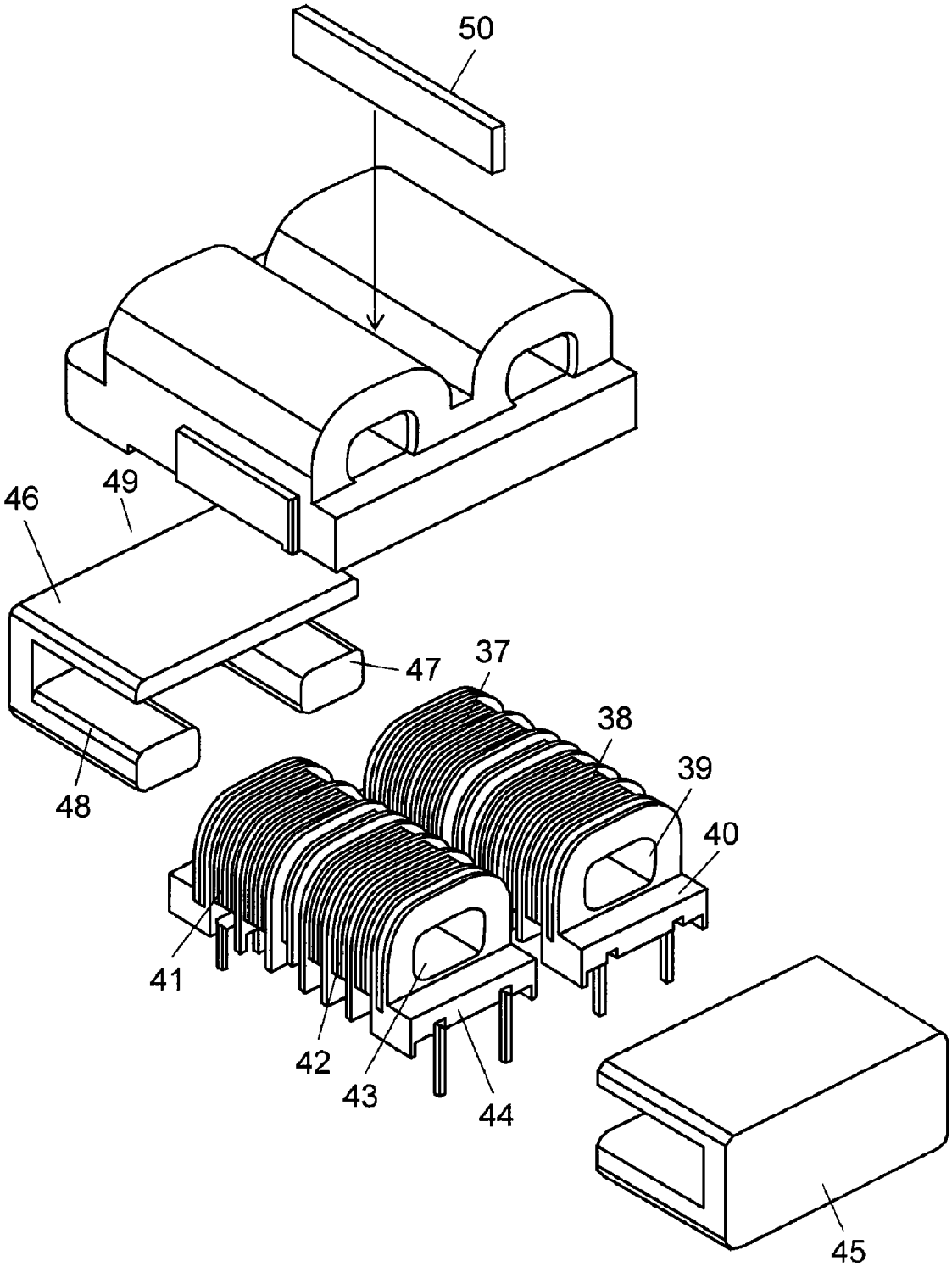
FIG. 8 is an exploded perspective view of a transformer according to the second exemplary embodiment of the present invention.

FIG. 8 is an exploded perspective view of a transformer according to the second exemplary embodiment of the present invention. In FIG. 8, the transformer of the second embodiment includes first bobbin 40 and second bobbin 44. First bobbin 40 and second bobbin 44 are arranged in parallel with each other.

First bobbin 40 is formed from first primary winding 37 and first secondary winding 38 wound around first through hole 39. Second bobbin 44 is formed from second primary winding 41 and second secondary winding 42 wound around second through hole 43.

Here, first primary winding 37 and second primary winding 41 have the same winding number. First secondary winding 38 and second secondary winding 42 as well have the same winding number.

Further, the transformer of the second embodiment has divided magnetic core 49. Divided magnetic core 49 is composed of rear magnetic plate 45, side wall magnetic leg 46, first outer magnetic leg 47, and second outer magnetic leg 48. Side wall magnetic leg 46 is vertically linked to rear magnetic plate 45. First outer magnetic leg 47 and second outer magnetic leg 48 are placed in parallel with each other at one side of side wall magnetic leg 46 and are vertically linked to rear magnetic plate 45.

Then, first outer magnetic legs 47 are inserted from both sides of first through hole 39, and their front ends are butt-joined together in first through hole 39. In the same way, second outer magnetic legs 48 are inserted from both sides of second through hole 43, and their front ends are butt-joined together in second through hole 43. Further, both side wall magnetic legs 46 are butt-joined together. First bobbin 40 and second bobbin 44 result in a state covered with divided magnetic core 49. Here, rod-shaped magnetic core 50 is arranged equidistantly between first bobbin 40 and second bobbin 44.

Figure 9:
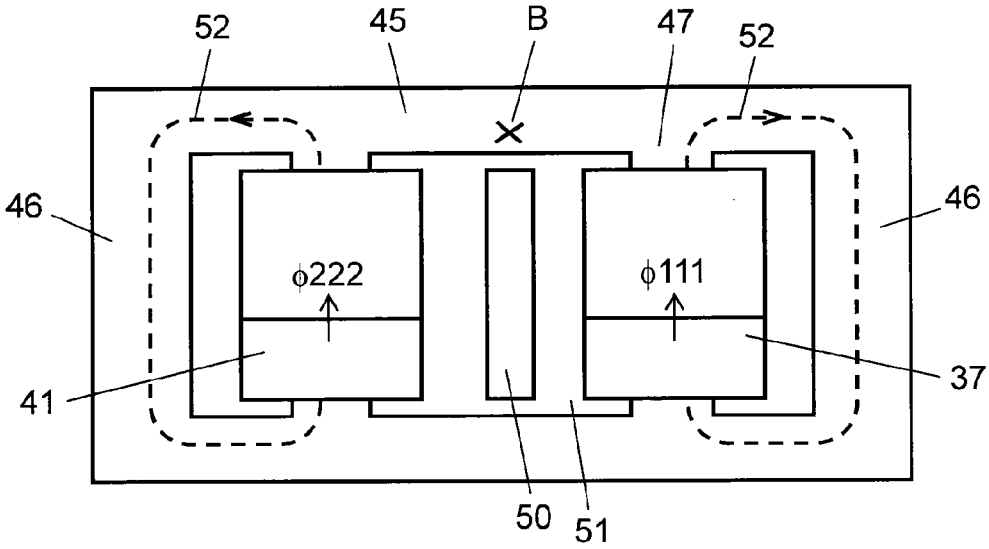
FIG. 9 is a plan view of the transformer according to the second embodiment of the present invention.

FIG. 9 is a plan view of the transformer according to the second embodiment of the present invention. In FIG. 9, point B is the center point of rear magnetic plate 45 composing divided magnetic core 49. Here, the transformer has a structure in which magnetic flux ϕ111 and ϕ222 generated at first primary winding 37 and second primary winding 41 unlikely head to point B. This is because point B is positioned in the direction in which magnetic flux ϕ111, ϕ222 conflicts with each other. This is also because rod-shaped magnetic core 50 placed in a direction in which magnetic flux ϕ111, ϕ222 can travel includes magnetic gap 51, which increases the reluctance. Consequently, the transformer has the same magnetic structure as that shown in FIG. 4, and magnetic flux ϕ111, ϕ222 shown in FIG. 9 passes through the magnetic path of magnetic flux loop 52. From all of the above, magnetic flux ϕ111, ϕ222 passes through different magnetic paths. This makes it hard for interference between first primary winding 37 and first secondary winding 38, and second primary winding 41 and second secondary winding 42 to occur.

Rod-shaped magnetic core 50 magnetically shields magnetic flux leakage discharged from first primary winding 37 and first secondary winding 38, and second primary winding 41 and second secondary winding 42 from each other.

In the second embodiment, rod-shaped magnetic core 50 is accompanied by magnetic gap 51 to increase the reluctance. Instead, the reluctance may be increased by reducing the cross-sectional area of rod-shaped magnetic core 50 with magnetic gap 51 eliminated.

As a method of reducing the reluctance of magnetic flux loop 52 and of decreasing occurrence of interference, the cross-sectional area of a part of rear magnetic plate 45 positioned between first outer magnetic leg 47 and side wall magnetic leg 46 is made smaller than the cross-sectional area of the other part of rear magnetic plate 45. This method is applicable to FIG. 4 as well.

Figure 10:
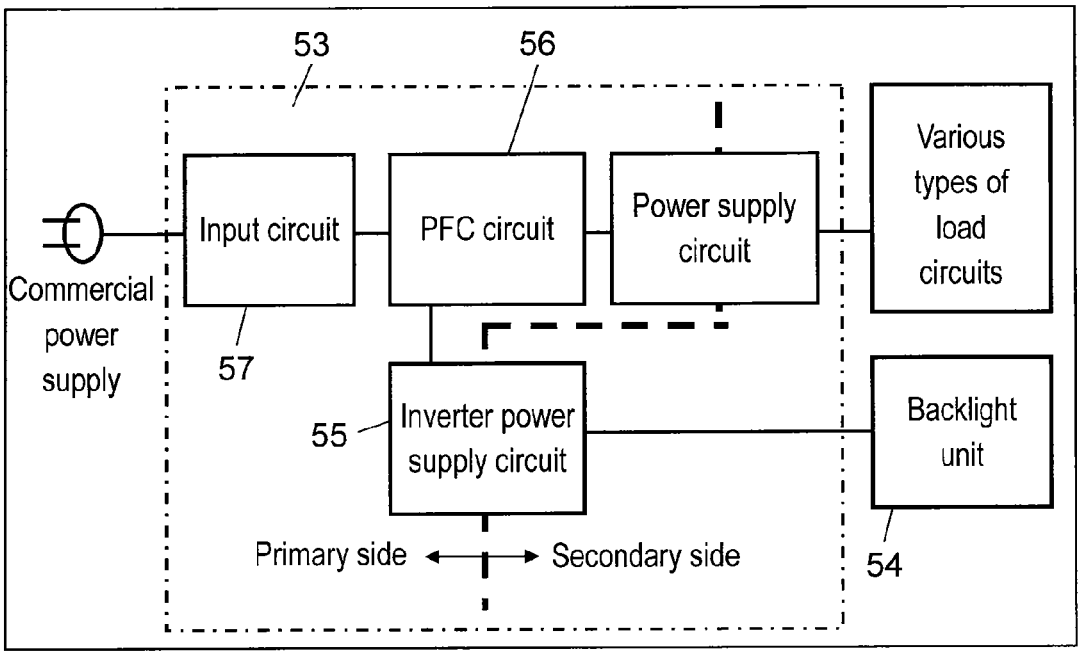
FIG. 10 is a block diagram of the power supply of the transformer according to the second embodiment of the present invention.
Figure 11:
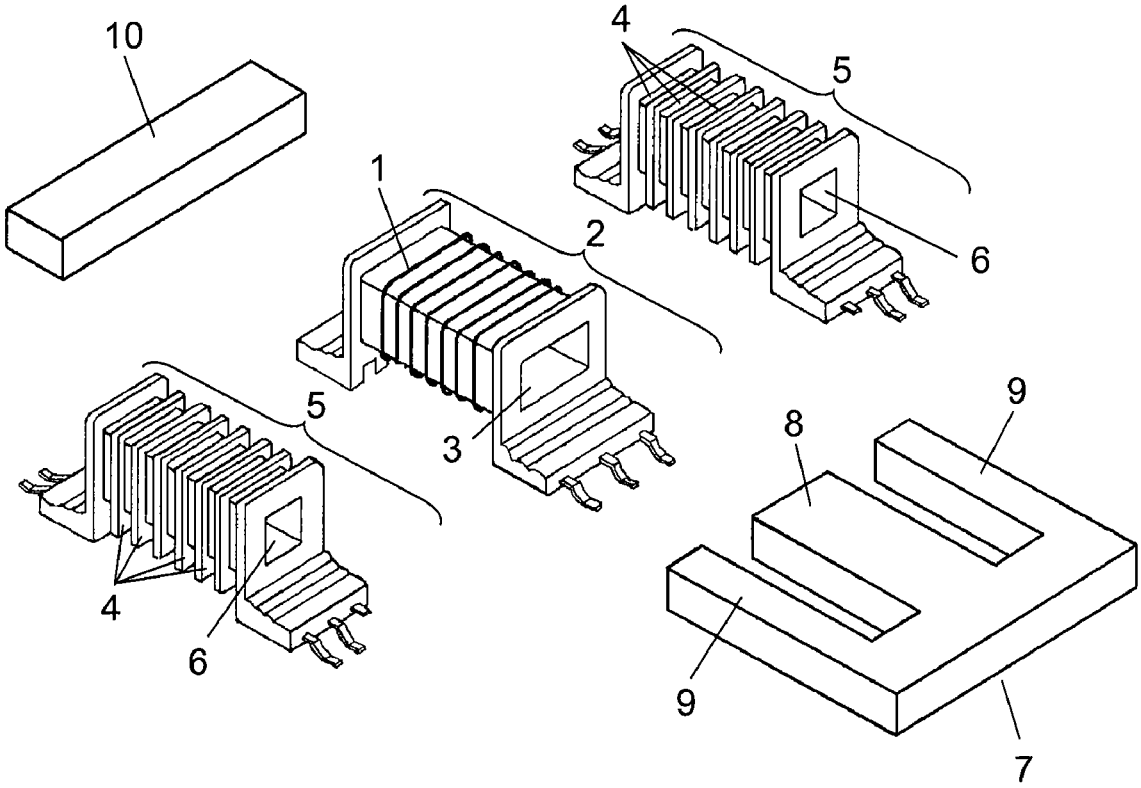
FIG. 11 PRIOR ART
FIG. 11 is an exploded perspective view of a conventional transformer.
Figure 12:
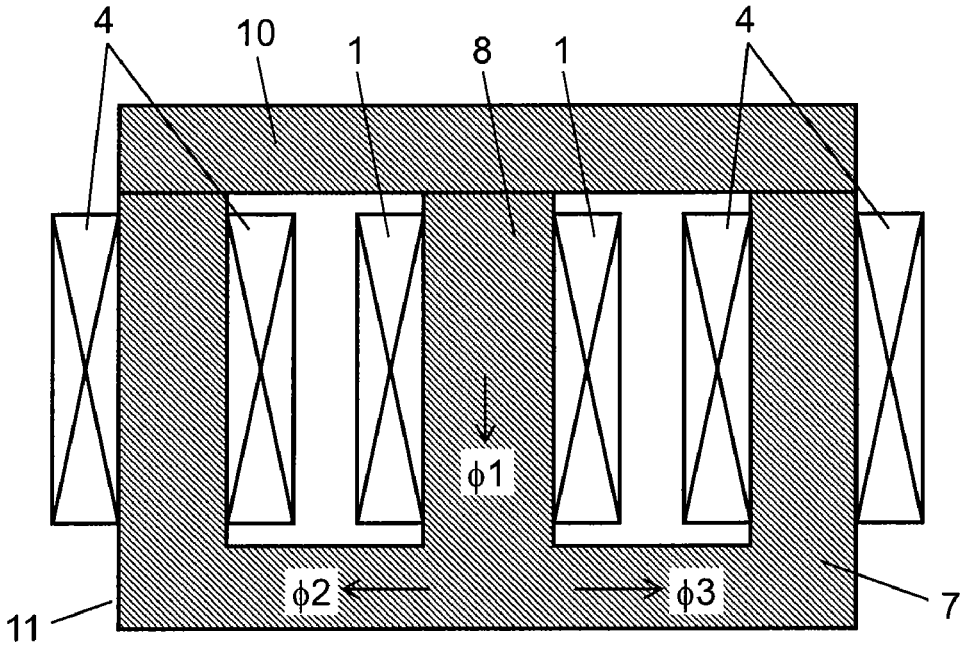
FIG. 12 PRIOR ART
FIG. 12 is a first sectional view of the conventional transformer.
Figure 13:
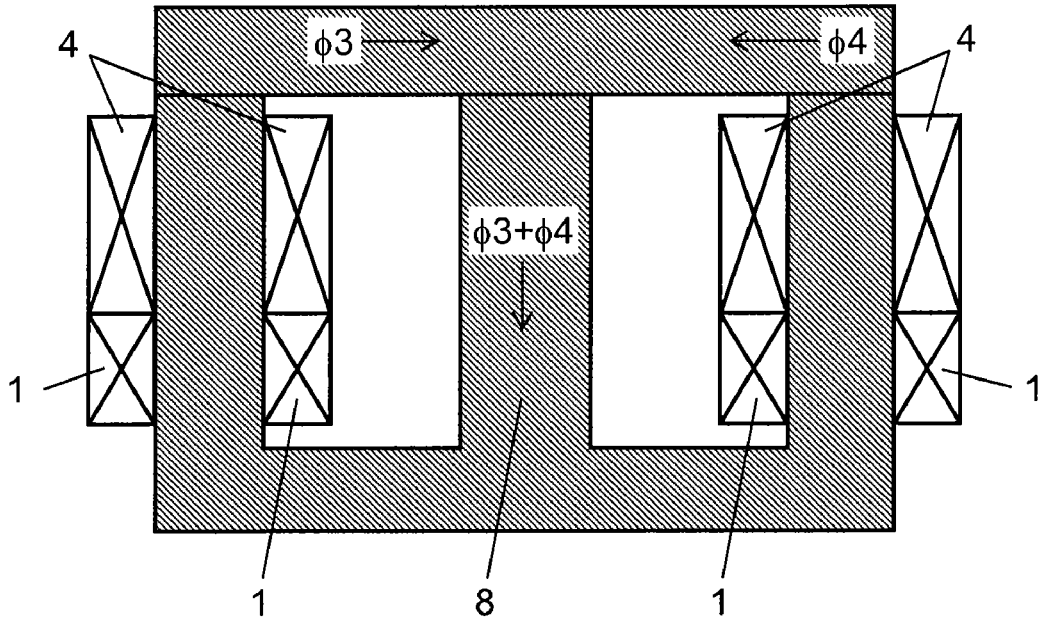
FIG. 13 PRIOR ART
FIG. 13 is a second sectional view of the conventional transformer.

FIG. 10 is a block diagram of the power supply including the transformer according to the second embodiment of the present invention. In FIG. 10, the transformer of the second embodiment works as inverter power supply circuit 55 inside power supply 53. Inverter power supply circuit 53 supplies backlight unit 54 with power. In this case, the transformer (not shown) has the function of insulating between the primary and secondary sides of inverter power supply circuit 55.

At this moment, power is to be directly supplied from PFC circuit (power factor correction, or harmonic measures circuit) 56 to inverter power supply circuit 55, and thus the power is converted only once. Consequently, higher efficiency is achieved with power loss suppressed, allowing lower power consumption. FIG. 10 shows power supply 53 including PFC circuit 56. Instead, power may be supplied from input circuit 57 directly to inverter power supply circuit 55 without a PFC circuit used.

Industrial Applicability

A transformer of the present invention makes hard for interference between the secondary windings to occur and has an effect of securing stable voltage output, and thus useful for various types of electronic appliances.

The invention claimed is:

1. A transformer comprising:

a first bobbin having a first primary winding and a first secondary winding wound around a first through hole:

a second bobbin having a second primary winding and a second secondary winding wound around a second through hole; and two divided magnetic cores inserted into the first through hole and the second through hole, wherein each of the divided magnetic core includes:

a center magnetic leg formed from a vertical wall for shielding vertically linked to a rear magnetic plate and a side wall vertically linked to the rear magnetic plate, wherein the vertical wall for shielding and the side wall are formed contiguously to each other, and wherein a cross section thereof is T-shaped;

a first outer magnetic leg placed at one side separated by the vertical wall; and a second outer magnetic leg placed at an other side separated by the vertical wall, wherein the first outer magnetic legs are inserted from both sides of the first through hole and butt-joined together, wherein the second outer magnetic legs are inserted from both sides of the second through hole and butt-joined together, and wherein the center magnetic legs are butt-joined together.

2. The transformer of claim 1, wherein the vertical walls for shielding are butt-joined through a gap at a part and in a contact state at an other part by providing a stepped part at a butt-joined part of the vertical wall for shielding of the center magnetic leg.

3. The transformer of claim 1, wherein at least one of the first outer magnetic legs and the second outer magnetic legs are butt-joined together through a magnetic gap.

4. The transformer of claim 1, wherein the divided magnetic cores are bilaterally symmetric with respect to the vertical wall for shielding of the center magnetic leg.

5. The transformer of claim 1, wherein distance from the first outer magnetic leg and the center magnetic leg to the side wall is smaller than distance from the first outer magnetic leg and the center magnetic leg to the vertical wall for shielding, and wherein distance from the second outer magnetic leg and the center magnetic leg to the side wall is smaller than distance from the second outer magnetic leg and the center magnetic leg to the vertical wall for shielding.

6. The transformer of claim 1, wherein a cross-sectional area of the side wall is twice or more of a cross-sectional area of the vertical wall for shielding.

7. The transformer of claim 1, wherein the vertical wall for shielding is placed at a position deviating from a center of the divided magnetic core, and wherein an area of a part of the vertical wall for shielding butt-joined together is smaller than a cross-sectional area of the vertical wall for shielding.

8. A power supply comprising:

a backlight unit; and an inverter power supply circuit starting the backlight unit, wherein the inverter power supply includes the transformer of claim 1.

* * * * *